US011692761B2

(12) United States Patent
Lee

(10) Patent No.: US 11,692,761 B2
(45) Date of Patent: Jul. 4, 2023

(54) REFRIGERATOR

(71) Applicant: LG ELECTRONICS INC., Seoul (KR)

(72) Inventor: Sung Hun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/354,472

(22) Filed: Jun. 22, 2021

(65) Prior Publication Data

US 2021/0404730 A1 Dec. 30, 2021

(30) Foreign Application Priority Data

Jun. 30, 2020 (KR) ..... 10-2020-0080135

(51) Int. Cl.
*F25D 23/02* (2006.01)

(52) U.S. Cl.
CPC ..... *F25D 23/025* (2013.01); *F25D 23/02* (2013.01); *F25D 23/028* (2013.01); *F25D 2323/021* (2013.01); *F25D 2323/023* (2013.01)

(58) Field of Classification Search
CPC ..... F25D 23/025; F25D 2323/021; F25D 2323/023; F25D 23/028
See application file for complete search history.

(56) References Cited

U.S. PATENT DOCUMENTS 9,170,045 B2 * 10/2015 Oh ..... E05D 11/0081
9,308,677 B2 * 4/2016 Lee ..... F25D 23/028
10,295,248 B2 * 5/2019 Miller ..... F25D 23/04
10,598,427 B2 * 3/2020 Choi ..... F25D 27/005
2010/0192608 A1 8/2010 Lee et al.
2014/0132146 A1 * 5/2014 Kim ..... F25D 23/02 312/405.1
2016/0061511 A1 * 3/2016 Park ..... F25D 23/025 312/405
2016/0282035 A1 * 9/2016 Sul ..... F25D 27/00
2016/0356543 A1 * 12/2016 Park ..... E05C 3/30
2017/0191745 A1 * 7/2017 Choi ..... H05B 47/16
2017/0211874 A1 * 7/2017 Kim ..... G01H 1/00
2017/0370634 A1 12/2017 Kim et al.
2018/0031303 A1 2/2018 Kim et al.
2018/0112906 A1 * 4/2018 Yi ..... F25D 21/04
2018/0112909 A1 * 4/2018 Choi ..... F25D 23/025
2019/0032994 A1 * 1/2019 Choi ..... F25D 29/005
(Continued)

FOREIGN PATENT DOCUMENTS

KR 10-2019-0030295 A 3/2019
WO 2016031199 A1 3/2016

*Primary Examiner* — Kimberley S Wright
(74) *Attorney, Agent, or Firm* — Dentons US LLP

(57) ABSTRACT

A refrigerator includes a cabinet including a storage space; a main door to open and close the cabinet and defining an opening; and a sub door defining a front surface of the refrigerator and to open and close the opening of the main door. The main door includes a door frame defining the opening and contacting the sub door; a door liner coupled to the door frame to form an insulating space and defining a rear surface of the main door; and an inner frame defined along the opening of the main door inside of the insulating space and to support between the door frame and the door liner, where the inner frame includes a curved portion defined at a rear side of the inner frame, which connects to the door liner.

16 Claims, 11 Drawing Sheets

(56) References Cited

U.S. PATENT DOCUMENTS

| | | | | |
|---|---|---|---|---|
| 2019/0178568 | A1* | 6/2019 | Koo | A47F 3/0434 |
| 2019/0360745 | A1* | 11/2019 | Lee | F21V 33/0044 |
| 2019/0383551 | A1* | 12/2019 | Choi | C08L 33/12 |
| 2020/0359786 | A1* | 11/2020 | Watts | A47B 77/02 |
| 2020/0363121 | A1* | 11/2020 | Kim | F25D 23/025 |
| 2021/0164719 | A1* | 6/2021 | Kim | H05B 3/34 |
| 2021/0262722 | A1* | 8/2021 | Son | F25D 23/025 |
| 2021/0325104 | A1* | 10/2021 | Kang | F25D 23/028 |
| 2021/0404730 | A1* | 12/2021 | Lee | F25D 23/025 |

* cited by examiner

[FIG. 1]
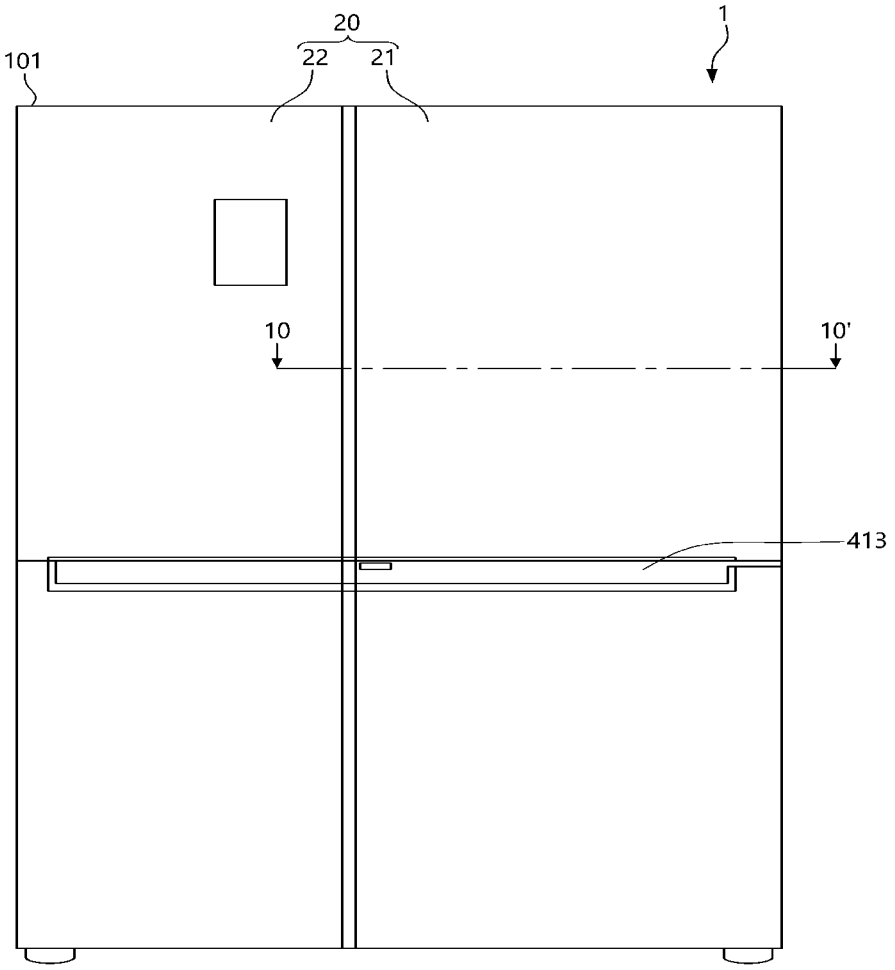

[FIG. 2]
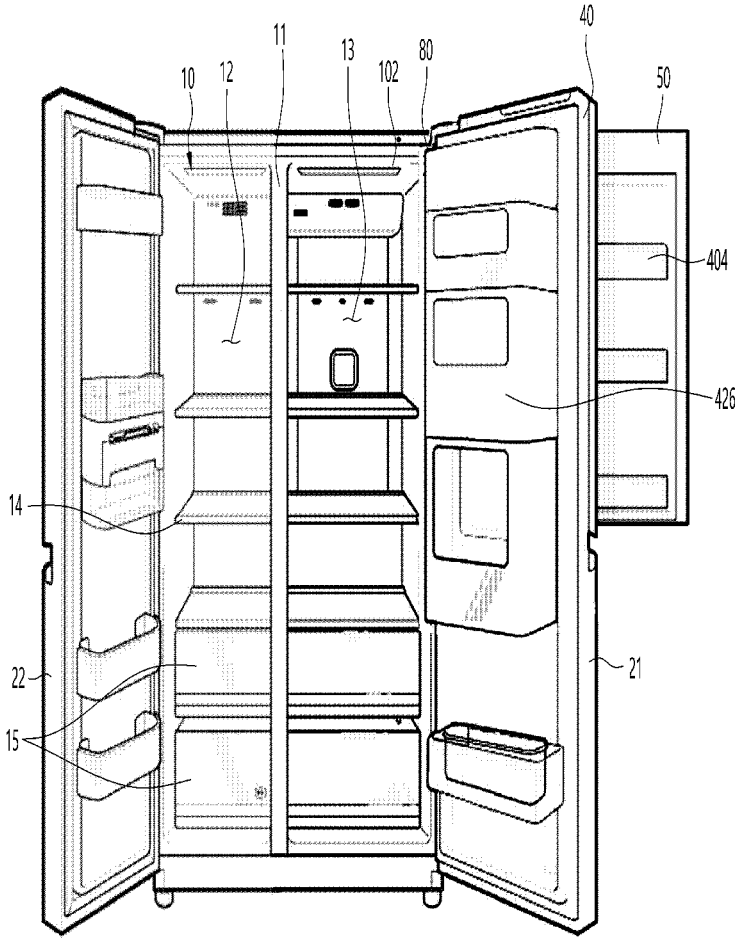

[FIG. 3]
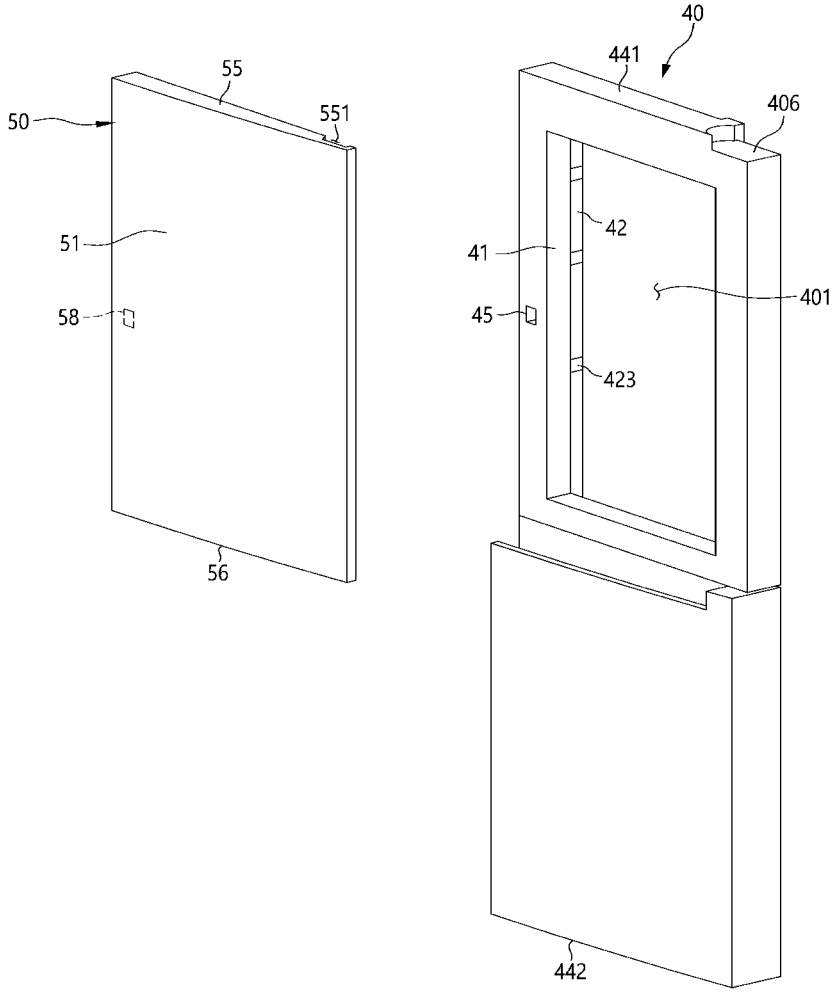

[FIG. 4]
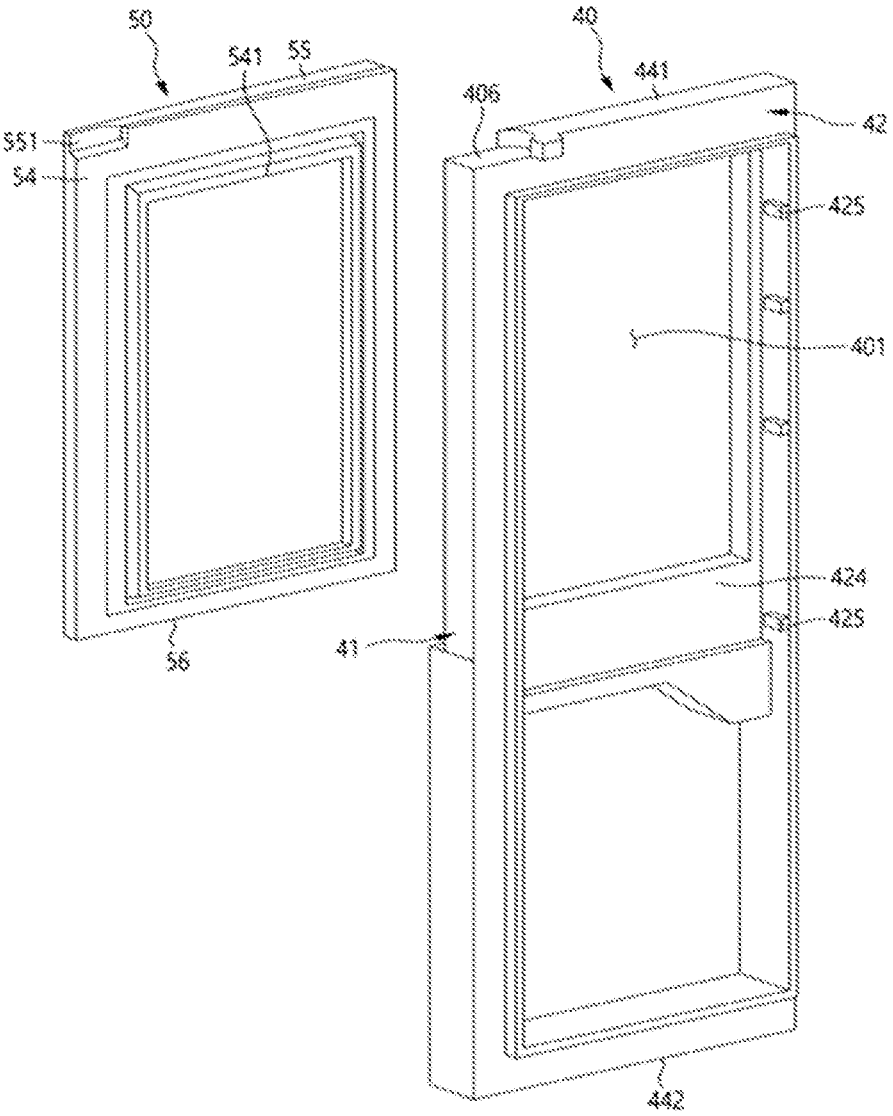

[FIG. 5]
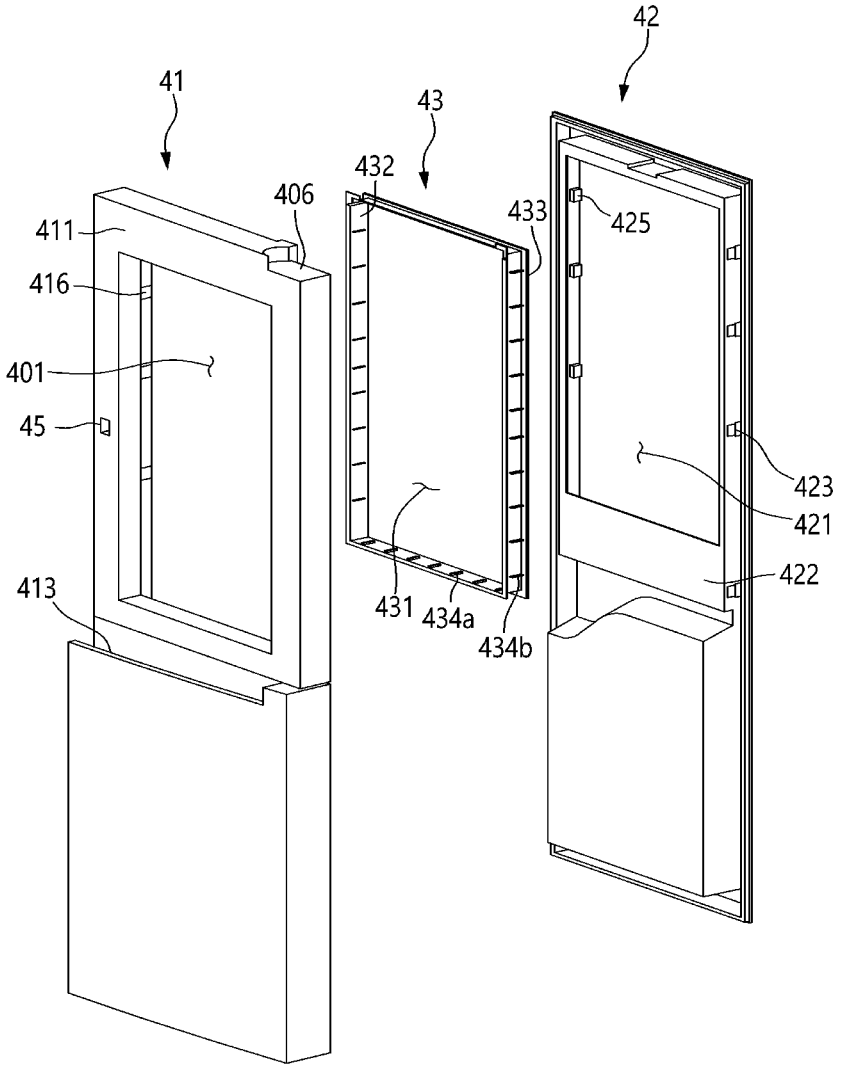

[FIG. 6]
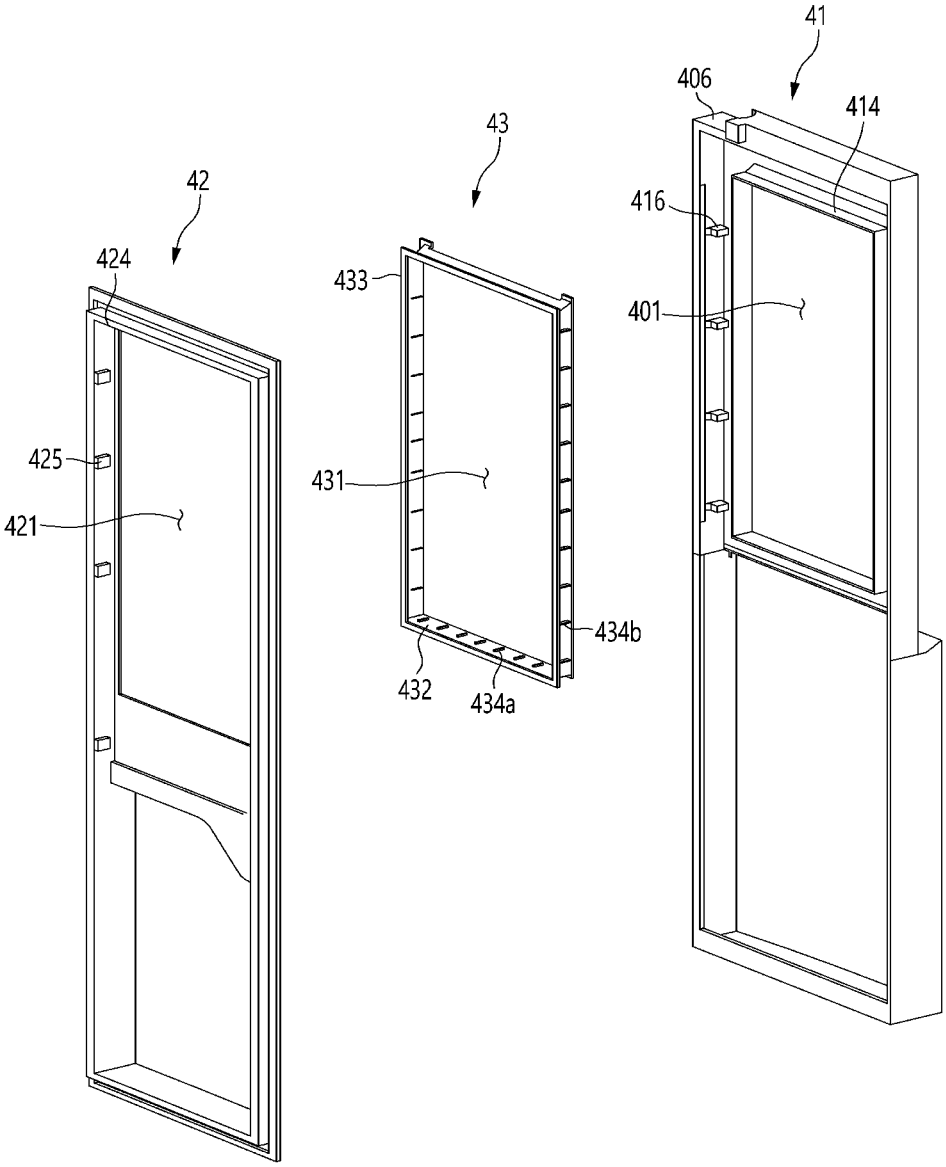

[FIG. 7]
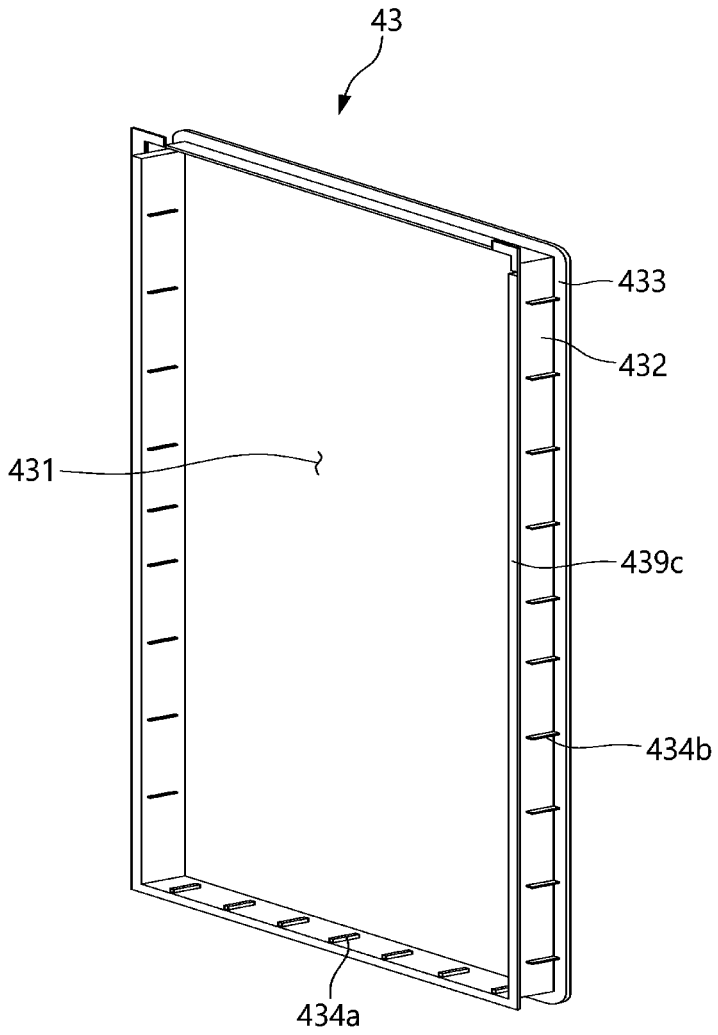

[FIG. 8]
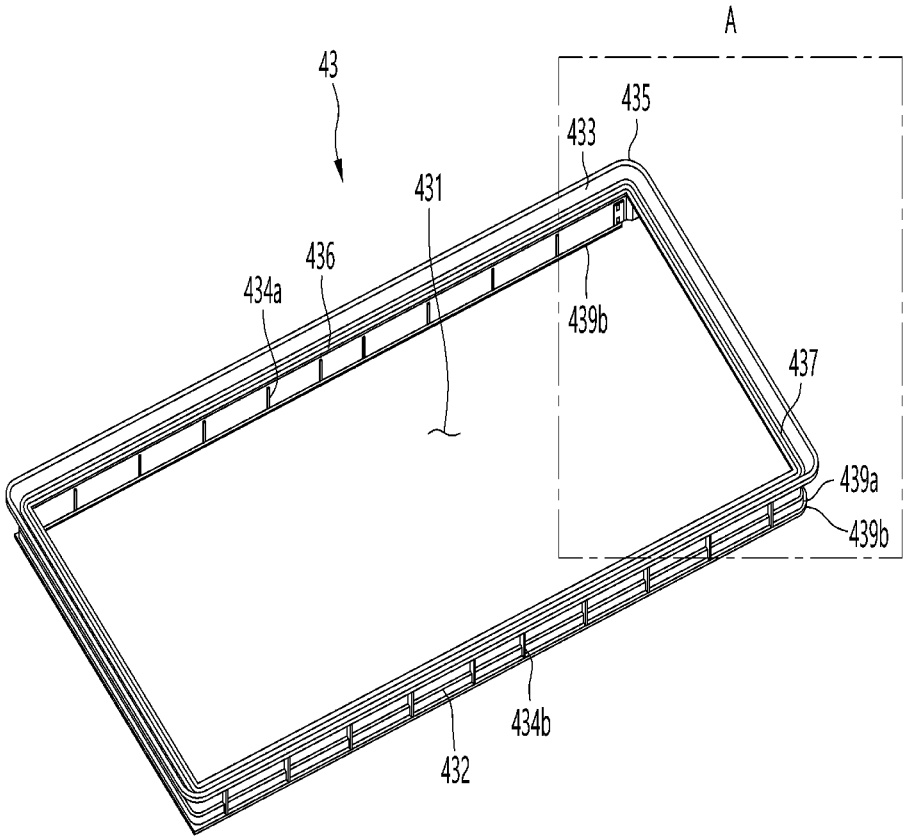

[FIG. 9]
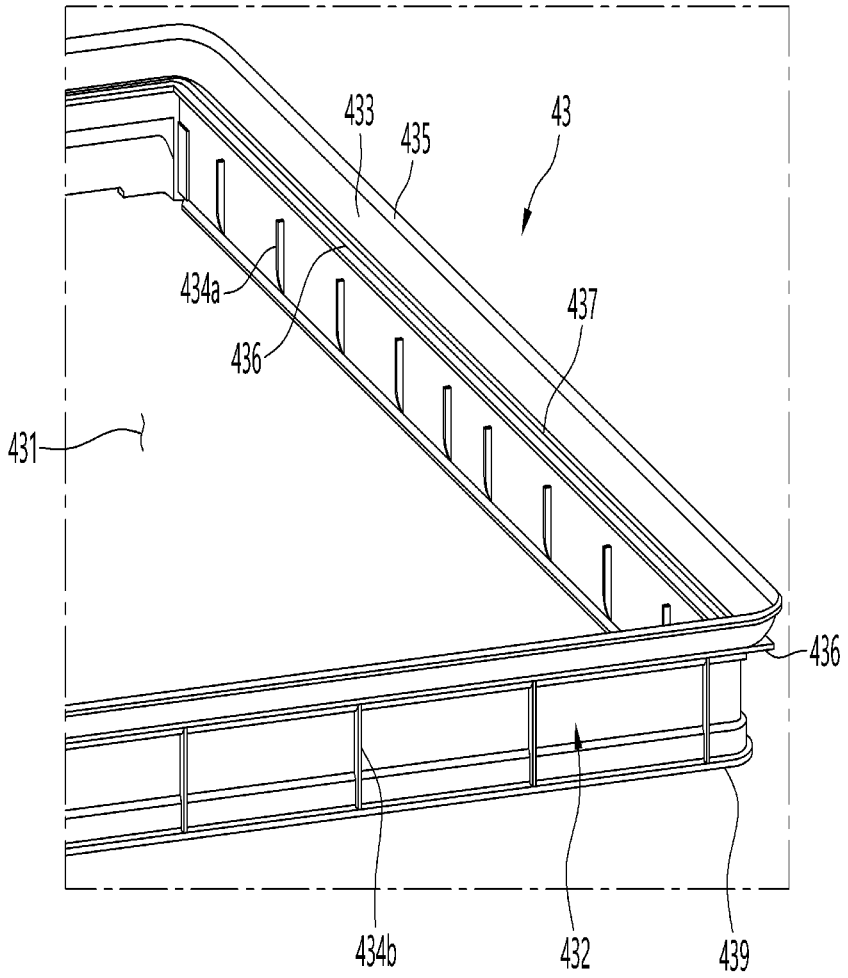

[FIG. 10]
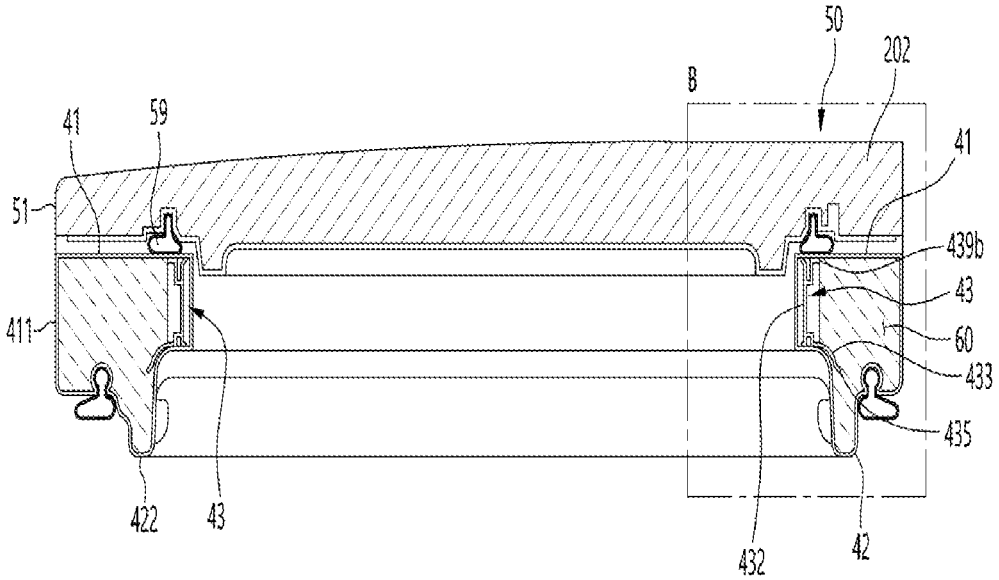

[FIG. 11]
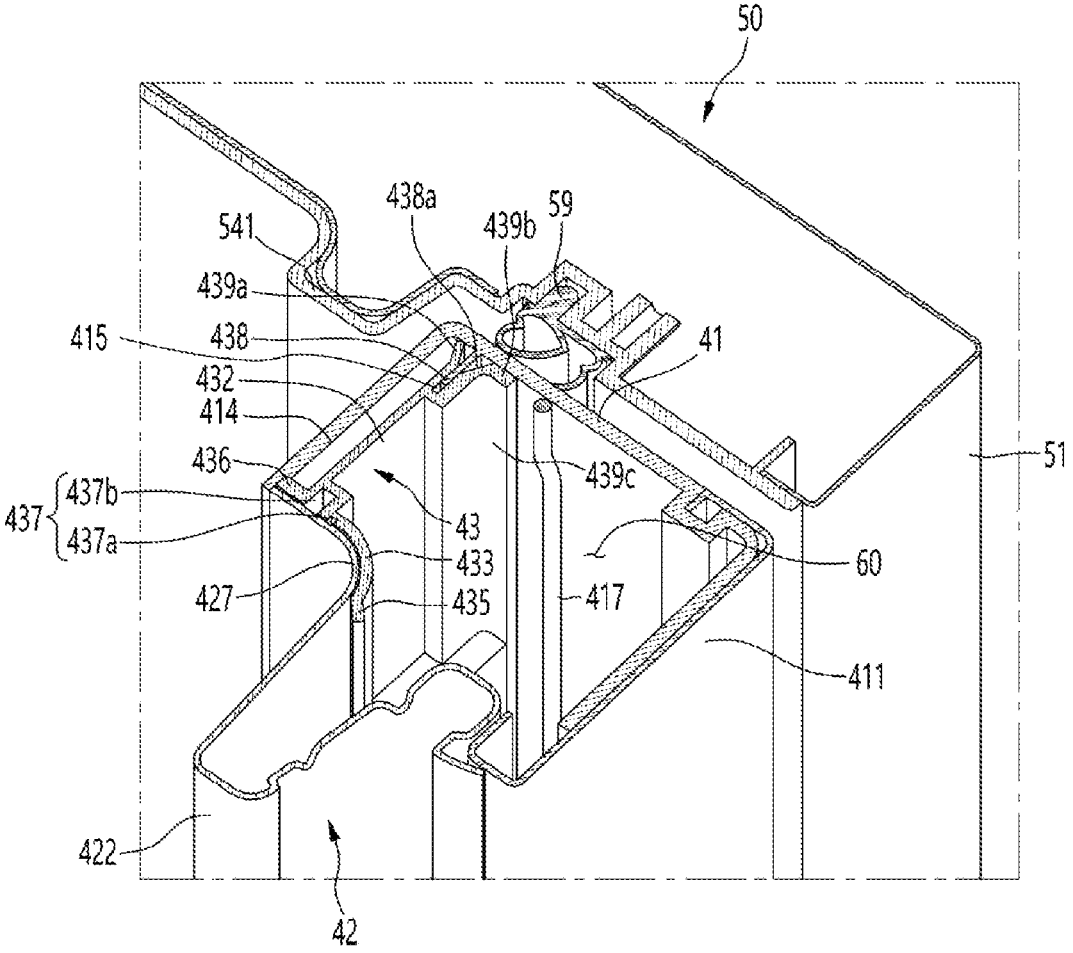

REFRIGERATOR

CROSS-REFERENCE TO RELATED APPLICATION

This application claims priority to and the benefit of Korean Patent Application No. 10-2020-0080135, filed on Jun. 30, 2020, the disclosure of which is incorporated herein by reference in its entirety.

BACKGROUND

Technical Field

The present disclosure relates to a refrigerator.

2. Description of Related Art

A refrigerator is a home appliance capable of storing food at a low temperature in an internal storage space closed by a door. The refrigerator may store the food in an optimal state by cooling an inside of the storage space using cold air generated by heat exchange with refrigerant circulating in a refrigeration cycle.

Refrigerators have become larger in size and more multifunctional according to changes in dietary life and the trend of high-quality products. In addition, refrigerators including various structures and convenience devices may provide user convenience and efficient use of the internal space thereof.

A refrigerator in which only a portion of the storage portion is opened has been provided. For example, a refrigerator including a sub door may be provided in a main door to open and close a sub storage portion defined in a main storage portion. The sub storage portion may be a partial area of the main storage portion and may be at least partially partitioned from the main storage portion by a partition wall. Such a refrigerator may be referred to as "a door in door (DID) refrigerator".

The refrigerator may store items such as beverages that are frequently used in the sub storage portion. The user may access the sub storage portion by opening the sub door without opening the main door. In addition, exposure of the cold air in the main storage portion to the outside may be reduced by opening the sub door, thereby obtaining energy efficiency.

Korean Patent Publication No. 10-2019-0030295 discloses a refrigerator including a filler to insulate a gasket mounting portion, thereby improving a thermal insulation performance of the door.

In the method of manufacturing the door in the related art, foaming liquid is injected when a door liner is manufactured by vacuum forming. An exterior member defining an appearance of the door are disposed on a jig, and then the jig is operated to couple the door liner and the exterior member. Based on the coupling, the door is assembled.

When the door liner manufactured by vacuum forming is used in the door manufacturing method, excellent productivity and economical efficiency may be obtained. However, the method has difficulties in precise molding to fit the dimensions. Such a door liner may not couple precisely to the exterior member to contact with the exterior member, resulting in a gap being generated between the door liner and the exterior member.

In the related art, an additional component is provided to block the gap for preventing leakage of the foaming liquid into the gap. Thus, an additional process of finishing the gap is needed, thereby complicating the assembly process.

SUMMARY OF THE DISCLOSURE

The present disclosure provides a refrigerator including a door to achieve a thermal insulation performance and facilitate an assembly operation when manufacturing a door in door (DID) refrigerator.

The present disclosure also provides a refrigerator that may prevent a step between a door frame and a door liner due to tolerance when assembling the door frame to the door liner, thereby providing a neat appearance.

The present disclosure further provides a refrigerator to minimize a gap between the door frame and the door liner, which does not require a post process of closing the gap after injecting foaming liquid, thereby improving productivity and economic efficiency.

The refrigerator according to an embodiment of the present disclosure includes an inner frame connecting the door frame and the door liner.

According to an embodiment of the present disclosure, a refrigerator includes a cabinet providing a storage space, a main door to open and close the cabinet and defining an opening, and a sub door to open and close the opening of the main door. The main door includes a door frame including the opening and defining a front surface of the main door; a door liner coupled to the door frame to provide an insulating space and defining a rear surface of the main door; and an inner frame disposed inside the insulating space along a circumference of the opening of the main door and connecting the door frame to the door liner; where a curved portion is defined at a rear side of the inner frame, which connects to the door liner.

The door further includes an insulating material filled in the insulating space and the insulating material is formed by injecting foaming liquid, which applies pressure on the curved portion.

The inner frame may further include an inner opening that penetrates an area corresponding to the opening of the main door in a forward and rearward direction; and a body disposed along a circumference of the inner opening and that extends between the door frame and the door liner in a forward and rearward direction, and the curved portion may be rounded and extend rearward from a rear end of the body.

The door liner may include a liner opening that communicates with the opening of the main door; a rear frame that protrudes rearward along a circumference of the liner opening; and a connector connecting the liner opening and the rear frame.

The curved portion may be in surface contact with the connector.

The inner frame may further include a supporter that extends from the rear side of the body in a direction toward the opening of the main door.

The door frame may include a frame stepped portion that protrudes rearward along the circumference of the opening of the main door at a rear surface thereof and the supporter may extend to a point where the frame stepped portion and the connector meet.

The door frame may include a fixer that protrudes rearward for coupling to the inner frame.

The inner frame may further include an insertion portion recessed rearward to insert the fixer and the insertion portion may include a pair of opposing surfaces that are spaced apart from each other by a predetermined distance.

At least one of the pair of opposing surfaces of the insertion portion may include an inclined surface and the distance of the inclined surface decreases going toward a rear of the inclined surface from a front of the inclined surface.

The frame supporter may be disposed at either side of the insertion portion and extends toward the door frame.

The frame supporter may include: a first frame supporter that is bent and extends from a front end of the body in a direction toward the liner opening; and a second frame supporter that is bent and extends from the front end of the body in a direction away from the liner opening.

The second frame supporter may further include a supporting surface that extends to contact a portion of a rear surface of the door frame.

The inner frame may further include a fixing groove defined between the supporter and the curved portion and recessed to accommodate an adhesive member.

The fixing groove may be defined on a same extension line as the insertion portion in a forward and rearward direction.

The inner frame may further include a bending portion that is bent and extends from an end of the curved portion.

The bending portion may be inclined toward the front as the bending portion is away from the liner opening.

The inner frame may further include a plurality of first protrusions that protrude inward along a circumference of the body and are spaced apart from one another at regular distance.

The inner frame may further include a plurality of second protrusions that protrude outward along the circumference of the body and are spaced apart from one another at regular distance.

A distance between the door frame and the door liner may be less than 5 mm.

The refrigerator according to the embodiments of the present disclosure may expect the following effects.

According to the present disclosure, the refrigerator includes an inner frame between the door frame and the door liner that may minimize the gap between the door liner and the door frame.

A gap sealing component to prevent the leakage of the foaming liquid to the outside in the process of manufacturing the main door by coupling the door frame to the door liner may be removed, thereby simplifying the manufacturing process and reducing costs thereof.

In addition, the refrigerator according to the present disclosure may provide a sense of unity by minimizing the step between the door frame and the door liner of the main door.

In particular, a coupling portion between the door frame and the door liner may be exposed through the opening when the sub door is opened. The refrigerator according to the present disclosure may not require an additional component to block the gap by minimizing the gap between the door frame and the door liner.

The inner frame of the present disclosure includes a curved portion rounded to surround the door liner and couples the door liner and the door frame in contact with one another.

In addition, the inner frame of the present disclosure includes a bending portion bent and connected to the curved portion that may prevent the foaming liquid from penetrating into the space between the door liner and the inner frame when the foaming liquid is injected into the door frame.

In addition, the inner frame includes a supporter that extends inward from a rear side of the body that may firmly support the door liner.

In addition, the inner frame further includes a frame supporter to support the door frame, so the inner frame and the door frame may be coupled more firmly.

BRIEF DESCRIPTION OF THE DRAWINGS

FIG. 1 is a front view of an exemplary refrigerator.

FIG. 2 is a front view of the refrigerator with all doors open.

FIG. 3 is an exploded perspective view of a main door and a sub door when viewed from the front.

FIG. 4 is an exploded perspective view of the main door and the sub door when viewed from the rear.

FIG. 5 is an exploded perspective view of the main door when viewed from the front.

FIG. 6 is an exploded perspective view of the main door when viewed from the rear.

FIG. 7 is a perspective view of an inner frame.

FIG. 8 is a perspective view of the inner frame of FIG. 7 when viewed from another direction.

FIG. 9 is a perspective view of a portion A of FIG. 8 when viewed from another direction.

FIG. 10 is a cross-sectional view taken along line 10-10' of FIG. 1.

FIG. 11 is a cross-sectional view of a portion B of FIG. 10 when viewed from another direction.

DETAILED DESCRIPTION OF EXEMPLARY EMBODIMENTS

Hereinafter, exemplary embodiments of the present disclosure will be described in detail with reference to the accompanying drawings. Meanwhile, the spirit of the present disclosure is not limited to the suggested embodiments, but those skilled in the art can suggest another retrogressive disclosure or another embodiment which falls within the spirit of the present disclosure through addition of another component, or modification or deletion of a component.

In addition, the embodiment of the present disclosure is described by exemplifying a side by side type refrigerator including a freezing portion and a refrigerating portion on the left side and the right side for convenience of explanation and understanding, but the present disclosure may be applied to all types of refrigerators, including a shelf in a refrigerator storage portion.

FIG. 1 is a front view of an exemplary refrigerator. FIG. 2 is a front view of a refrigerator including a space inside of a storage portion.

As shown in the drawings, an outer appearance of a refrigerator 1 according to an embodiment of the present disclosure may be defined by a cabinet 10 including a storage space and a door 20 to open and close the storage space of the cabinet 10.

Hereinafter, for convenience of explanation and understanding, an arrangement direction of the door 20 in a refrigerator 1 is referred to as "a forward direction", an arrangement direction of the cabinet 10 closed by the door 20 is referred to as "a rearward direction", a direction facing the floor is referred to as "a downward direction", and a direction opposite to the direction facing the floor is referred to as "an upward direction".

In addition, a space surrounded by the cabinet 10 is referred to as "an inside space" and a space outside of the cabinet 10 is referred to as "an outside space".

The cabinet 10 may include an outer case 101 made of metal and defining an outer surface and an inner case 102 coupled to the outer case 101, including a storage space inside of the refrigerator, and made of resin. In addition, an insulating material is filled between the outer case 101 and the inner case 102 to insulate the space inside of the refrigerator from the outside space.

The storage space may be divided into the left side and right side with respect to a barrier 11 and may include a freezing portion 12 and a refrigerating portion 13. In the refrigerator, the freezing portion 12 may be disposed on the left side and the refrigerating portion 13 may be disposed on the right side thereof. However, this is only an example, and the freezing portion or the refrigerating portion may be disposed at an upper side or a lower side, or the freezing portion may be disposed at the right side and the refrigerating portion 13 may be disposed on the left side thereof.

In addition, a plurality of shelves 14 and drawers 15 are disposed in the freezing portion 12 and the refrigerating portion 13 defined by the inner case 102 to independently provide a space to store food.

The door 20 may include a refrigerating portion door 21 and a freezing portion door 22 to independently open and close the refrigerating portion 13 and the freezing portion 12. The refrigerating portion door 21 may open and close the opened front portion of the refrigerating portion based on rotation thereof and the freezing portion door 22 may open and close an opened front portion of the freezing portion based on the rotation thereof.

The refrigerating portion door 21 may be opened and closed in double. For example, the refrigerating portion door 21 disposed on the right side (of FIG. 2) may include a main door 40 to open and close the refrigerating portion and a sub door 50 rotatably disposed in the main door 40 to open and close an opening of the main door 40.

The main door 40 may have the same size as the freezing portion door 21 disposed at the left side and an upper end of the main door 40 may be rotatably connected to the cabinet by a main hinge.

The upper end of the main door 40 may be rotatably connected to the cabinet 10 by a main hinge 80. Accordingly, the storage space inside of the cabinet 10 may be opened and closed based on the rotation of the main door 40.

In addition, the main door 40 includes an opening 401 (see FIG. 3). A door basket 404 is disposed on a rear surface of the sub door 50 and at an inside of the opening 401 of the main door 40. Therefore, the user may access the door basket 40 through the opening 401 without opening the main door 40. In this case, the opening 401 occupies an upper portion of the main door 40 except for a portion of a circumference of the main door 40.

The sub door 50 is disposed at a front surface of the main door 40 and an upper end of the sub door 50 may be rotatably connected to the main door 40 by a sub-hinge. The opening 401 of the main door 40 may be opened and closed based on the rotation of the sub door 50.

The sub door 50 has a size such that the sub door 50 may close the opening 401 of the main door 40 when viewed from the front. In addition, when the main door 40 and the sub door 50 are closed, the sub door 50 may have the same size as the freezing portion door 21 disposed at the left side and may define an appearance which seems to be a door. The door may be referred to as "door in door (DID)".

FIG. 3 is an exploded perspective view of the main door 40 and the sub door 50 when viewed from the front. In addition, FIG. 4 is an exploded perspective view of the main door 40 and the sub door 50 when viewed from the rear. In addition, FIG. 5 is an exploded perspective view of the main door 40 when viewed from the front. In addition, FIG. 6 is an exploded perspective view of the main door 40 when viewed from the rear.

As shown in the drawings, a shape of the sub door 50 may correspond to that of an opening of the main door 40. The sub door 50 may include a sub-outdoor 51 defining an outer appearance, a sub-door liner 54 spaced apart from the sub-outdoor 51, and a sub-upper cap deco 55 and a sub-lower cap deco 56 defining an upper surface and a lower surface of the sub door 50. The outer appearance of the sub door 50 may be defined by coupling the components described above together.

The sub-outdoor 51 defines a front appearance and a portion of circumferential surface of the sub door 50, has a plate shape, and may be made of stainless steel material. In addition, the sub-outdoor 51 may be made of the same material as the front surface of each of the refrigerating portion door 21 and the freezing portion door 22.

A sub-door liner 54 is disposed at a rear side of the sub-outdoor 51. The sub-door liner 54 defines a rear surface of the sub door 50 and may be injection-molded from plastic material.

The sub-door liner 54 is coupled to each of the sub-outdoor 51, the sub-upper cap deco 55, and the sub-lower cap deco 56. In addition, an insulating material is filled by injecting a foaming liquid into an inner space around the sub door 50 defined by the sub-door liner 54, thereby providing an insulating structure at the circumference of the sub door 50.

In addition, a stepped portion 541 that protrudes rearward along the circumference thereof may be defined on a rear surface of the sub-door liner 54. The stepped portion 541 may be provided at a position corresponding to the circumference of the opening 401 of the main door 40. The stepped portion 541 may be inserted into the main door 40 to further seal the gap between the sub door 50 and the main door 40.

A storage member such as a shelf or a basket may be disposed on the rear surface of the sub-door liner 54. Accordingly, the user may access the storage member disposed on the rear surface of the sub door 50 without opening the main door 40. The storage members disposed on the sub-door liner 54 may have a form of basket and a plurality of storage members may be provided as necessary to provide a storage space.

The sub-upper cap deco 55 defines an upper surface of the sub door 50 and may be coupled to an upper side of each of the sub-outdoor 51 and the sub-door liner 54.

In addition, an upper hinge mounting portion 551 may be disposed at an end of the sub-upper cap deco 55. The upper hinge mounting portion 551 may be recessed downward to provide a space to mount the upper hinge.

The sub-lower cap deco 56 defines a lower surface of the sub door 50 and may be coupled to a lower side of each of the sub-outdoor 51 and the sub-door liner 54. In addition, a lower hinge mounting portion may be disposed at one end of the sub-lower cap deco 56 and may be recessed to accommodate the lower hinge.

In addition, a sub gasket 59 (see FIG. 10) may be disposed on the rear surface of the sub-door liner 54 to block the space between the sub door 50 and the main door 40.

A locking portion 58 may be disposed on a rear surface of the sub door 50 to selectively release the coupling of the sub door 50 to the main door 40. When the user presses the button of the locking portion 58, the state of coupling with the restraining member 45 of the main door 40 may be released and the locking portion 58 may be separated from the restraining member 45. Then, when the user opens the sub door 50, the main door 40 remains closed and only the sub door 50 is opened to access the storage space inside of the main door 40.

The main door 40 may include a door frame 41 defining a front surface of the main door 40, a door liner 42 spaced apart from the door frame 41 and defining a rear surface of the main door 40, and an inner frame 43 disposed between the door frame 41 and the door liner 42 to support the door frame 41 and the door liner 42.

The door frame 41 may define a portion of a front surface and a circumferential surface of the main door 40. In addition, an area corresponding to the opening 401 is opened.

The door frame 41 may include an outer door 411 substantially defining an outer appearance of the main door 40. The outer door 411 may define the front surface and both sides of the main door 40.

In addition, a rear gasket 435 may be disposed at a circumference of a rear surface of the door liner 42. The rear gasket 435 contacts a circumference of a cabinet to prevent leakage of cold air between the main door 40 and the cabinet.

A cap deco defines an upper surface and a lower surface of the main door 40 and a hinge mounting portion 406 may rotatably mount the main door 40 on the cabinet. An upper side of the main door 40 is coupled to the main hinge to rotatably support the main door 40 from the upper side and the lower side.

In addition, a door handle 413 may be recessed from a side of the main door 40, and the user may put their hand into the door handle 413 to rotate the main door 40. The user may open and close the refrigerating portion 12 based on the rotation of the main door 40.

A foaming liquid is filled in the inner space of the main door 40 to form an insulating material when the door frame 41, the door liner 42, and the cap deco are coupled. That is, the insulating material is disposed inside of a circumferential area of the opening 401 to insulate the space inside of the refrigerator from the space outside of the refrigerator.

The door frame 41 may be injection-molded with a plastic material that is different from a material of the door liner 42. For example, the door frame 41 is injection-molded with a plastic material harder than that of the door liner 42, thereby obtaining high strength of the main door 40.

In addition, a frame stepped portion 414 that protrudes inward may be defined at a rear side of the door frame 41. The frame stepped portion 414 may protrude rearward along a circumference of the opening of the main door 40. A stepped portion 541 of the sub door 50 may be inserted into the frame stepped portion 414. When the sub door 50 is closed, the frame stepped portion 414 contacts the stepped portion 541 of the sub door 50 to support the sub door 50 while sealing between the main door 40 and the sub door 50.

A front gasket may be disposed on the frame stepped portion 414. When the sub door 50 is closed, the front gasket contacts a rear surface of the sub door 50 to seal between the main door 40 and the sub door 50. The front gasket may be omitted as necessary. In addition, the front gasket may have a sheet shape made of metal, and may contact the gasket 59 of the sub door 50 being magnetic by magnetic force.

The door frame 41 includes a fixer 415 (see FIG. 11) on a rear surface thereof and the fixer 415 protrudes rearward and is coupled to the inner frame 43. The fixer 415 may extend in a vertical direction along the rear surface of the door frame 41.

The fixer 415 may be disposed in a space to accommodate the inner frame 43 between the frame stepped portion 414 and a side surface of the door frame 41. The fixer 415 may have a length such that the fixer 415 may be sufficiently inserted into and coupled to an insertion portion 438 of the inner frame 43.

A fixing protrusion 416 may be disposed on an inner surface of the door frame 41, may protrude, and may be coupled to the door liner 42. A plurality of fixing protrusions 416 may be defined along the inner surface of the door frame 41 and may be spaced apart from one another in the vertical direction. The door frame 41 may be coupled to the door liner 42 by inserting the fixing protrusion 416 into a liner fixing groove 423 defined in the door liner 42.

A frame heater 417 (see FIG. 11) may be disposed on a rear surface of the frame stepped portion 414. The frame heater 417 is disposed along the frame stepped portion 414 to heat the frame stepped portion 414. A surface temperature of the frame stepped portion 414 may be relatively low due to an influence of cold air in the refrigerator. Therefore, dew condensation may be generated on the surface of the frame stepped portion 414 and the dew condensation may be prevented by driving the frame heater 417.

The door liner 42 defines a rear surface of the door, that is, a surface facing the inside of the refrigerator and includes a liner opening 421 opened to communicate with the inside of the refrigerator by an area corresponding to the opening 401.

In addition, the door liner 42 may be spaced apart from the door frame 41 and is coupled to the upper cap deco 441 and the lower cap deco 442 to provide a space filled with the insulating material.

The insulating material 202 (see FIG. 10) may be formed by a foaming liquid injected in a state in which the door frame 41, the door liner 42, the upper cap deco 441, and the lower cap deco 442 are assembled. The insulating material may be molded by filling the foaming liquid and the refrigerator 1 may block heat exchange between the space inside of the refrigerator and the outside space.

The front surface of the door liner 42 may be assembled to the rear surface of the door frame 41. That is, the door liner 42 may include a liner opening 421 that penetrates an area corresponding to the opening of the door frame 41 in a forward and rearward direction and a front frame 422 that protrudes forward along a circumference of the liner opening 421.

When the front frame 422 is inserted from the rear of the door frame 41, the front frame 422 may contact the frame stepped portion 414 of the door frame 41.

In addition, liner fixing grooves 423 may be defined at both sides of the front frame 422. The liner fixing groove 423 has a recessed shape such that the fixing protrusion 416 of the door frame 41 is inserted into the liner fixing groove 423. Based on the insertion thereof, the door frame 41 may be coupled to the door liner 42. A plurality of liner fixing grooves 423 may be spaced apart from one another in a vertical direction along a circumference of the front frame 422 at both sides.

In addition, the door liner 42 may further include a rear frame 424 on a rear surface thereof and the rear frame 424 protrudes rearward along a circumference of the liner opening 421.

A mounting protrusion 425 is defined on an inner surface of the rear frame 424 to fix the storage member 426 (see FIG. 2). The mounting protrusions 425 may be disposed at both sides of the liner opening 421.

In detail, the mounting protrusions 425 may protrude from both sides of the rear frame 424 and a plurality of mounting protrusions 425 may be provided in the vertical direction. The storage member 426 may be coupled to the rear surface of the main door 40 when the storage member 426 is mounted on the mounting protrusion 425. In addition, the left side, the right side, and a rear surface of the storage member 426 are supported by the mounting protrusion 425 to maintain a stable mounting state.

For the door liner 42, the front frame 422 and the rear frame 424 communicate with each other through the liner opening 421 and the door liner 42 may be mounted on the door frame 41 when the inner frame 43 is mounted on the door frame 41.

The inner frame 43 is disposed on the rear surface of the door frame 41 to couple the door frame 41 and the door liner 42 along a circumference of the opening 401.

Hereinafter, the inner frame according to the present disclosure is described in detail.

FIG. 7 is a perspective view of the inner frame 43. FIG. 8 is a perspective view of the inner frame 43 of FIG. 7 when viewed from another direction. FIG. 9 is a perspective view of a portion A of FIG. 8 when viewed from another direction. FIG. 10 is a cross-sectional view taken along line 10-10' of FIG. 1. FIG. 11 is a cross-sectional view of a portion B of FIG. 10 when viewed from another direction.

Referring to FIGS. 7 to 11, the inner frame 43 includes an inner opening 431 that penetrates an area corresponding to the opening 401 of the main door 40 in a forward and rearward direction, a body 432 disposed along a circumference of the inner opening 431 and having a predetermined thickness, and a curved portion 433 that extends rearward from a rear end of the body 432 and is rounded.

That is, the inner frame 43 has a substantially quadrangular frame shape, is provided at a position corresponding to the opening of each of the door frame 41 and the door liner 42 to block between the door frame 41 and the door liner 42.

The body 432 may extend along the circumference of the inner opening 431 in the forward and rearward direction and may have a predetermined thickness.

A thickness of the body 432 in a forward and rearward direction corresponds to that of the frame stepped portion 414 of the door frame 41 and an inner surface of the body 432 may contact an outer surface of the frame stepped portion 414.

A first protrusion 434*a* that protrudes along a circumference of the body 432 may be defined on an inner surface of the body 432. For example, a plurality of first protrusions 434*a* may be provided, may protrude inward from an upper side, a lower side, and both side surfaces of the body 432, and may be spaced apart from one another by a predetermined distance. In addition, the first protrusion 434*a* may extend from the inner surface of the body 432 in the forward and rearward direction.

The first protrusion 434*a* contacts an outer surface of the frame stepped portion 414 when the inner frame 43 is mounted on the frame stepped portion 414, thereby preventing separation of the inner frame 43 from the door frame 41.

In addition, a second protrusion 434*b* that protrudes along the circumference of the body 432 may be further defined on an outer surface of the body 432. For example, the second protrusion 434*b* may protrude outward from both side surfaces of the body 432 and may extend in the forward and rearward direction. In addition, the second protrusion 434*b* may extend from an upper side and a lower side of the body 432 in the forward and rearward direction and may protrude outward. In addition, a plurality of second protrusions 434*b* may be provided and may be spaced apart from one another by a predetermined distance along the circumference of the body 432.

The second protrusion 434*b* contacts between the door liner 42 and the inner frame 43 when the door liner 42 is mounted in contact with the outer surface of the body 432, thereby preventing separation of the door liner 42 from the inner frame 43.

The curved portion 433 may extend rearward from a rear side of the inner frame 43 toward the door liner 42 and may be rounded to surround the door liner 42.

In detail, the door liner 42 includes a connector 427 (see FIG. 11) connecting the rear frame 424 and the liner opening 421. The curved portion 433 may be rounded to surround a portion of each of the rear frame 424 and the connector 427. That is, the curved portion 433 may be defined along a curved portion between the rear frame 424 of the door liner 42 and the liner opening 421 of the door liner 42.

With this structure, when the door liner 42 is mounted on the door frame 41, the curved portion 433 restricts the movement of the door liner 42 such that the door liner 42 may be assembled at an exact position of the door frame 41.

In addition, when the foaming liquid is injected into the insulating space 60, the curved portion 433 contacts the door frame 41 by the pressure of the foaming liquid and the supporter 436 contacts the frame stepped portion 414 and the door liner 42.

Accordingly, a gap between the door liner 42 and the door frame 41 may be eliminated and the door liner 42 and the door frame 41 may be coupled in contact with each other.

The inner frame 43 according to the present disclosure includes the curved portion 433 to surround a portion of the door liner 42. When the door liner 42 is mounted on the door frame 41, the curved portion 433 guides the seating position of the door liner 42 and supports the door liner 42 to prevent a gap between the door liner 42 and the door frame 41. Therefore, when assembling the main door 40, the post-process of sealing between the door liner 42 and the door frame 41 may be omitted after the foaming liquid is injected, thereby simplifying the assembly process.

In addition, the curved portion 433 may further include a bending portion 435 that is bent outward at an end of the curved portion 433. The bending portion 435 may be provided in a space between the rear frame 424 and may be spaced apart from the door liner 42. The bending portion 435 may be inclined forward toward an outside thereof. Therefore, it is possible to effectively prevent penetration of the foaming liquid into a space between the door liner 42 and the inner frame 43 when the foaming liquid is injected into the main door 40.

In addition, the inner frame 43 may further include a supporter 436 that extends inward from a rear side of the body 432. That is, the inner frame 43 includes the curved portion 433 disposed at an outside of the body 432 and a supporter 436 disposed at an inner side of the inner frame 43.

In this case, a direction toward the liner opening 421 is referred to as "an inward direction" and a direction away from the liner opening 421 is referred to as "an outward direction".

The supporter 436 may extend from the body 432 to a point where the door frame 41 and the door liner 42 meet. That is, the supporter 436 may extend to a corner defined when the frame stepped portion 414 and the connector 427 meet.

The supporter 436 may support the connector 427 of the door liner 42 from the front of the connector 427 to prevent deformation of the shape of the door liner 42 and contacts the frame stepped portion 414 to fix the position of the door frame 41.

In addition, a fixing groove 437 may be further disposed at a side of the curved portion 433 and may be recessed to accommodate an adhesive member. The fixing groove 437 may be recessed between the curved portion 433 and the supporter 436.

The fixing groove 437 provides a space to accommodate the adhesive member for sealing between the inner frame 43 and the door liner 42, and firmly mount the door liner 42 on the inner frame 43.

The fixing groove 437 may extend from the curved portion 433 in a direction toward the contact position between the door frame 41 and the door liner 42.

For example, the fixing groove 437 may contact the connector 427 connecting the rear frame 424 to a side surface of the door liner 42. With this structure, separation of the door liner 42 from the inner frame 43 may be prevented.

In addition, the inner frame 43 may include a fixing groove 437 or may include a plurality of fixing grooves 437 as necessary. For example, the fixing groove 437 may include a first fixing groove 437*a* and a second fixing groove 437*b* that are arranged in a line in a direction toward the opening from the connector 427.

In addition, a size of the first fixing groove 437*a* may be different from that of the second fixing groove 437*b*, and in the present disclosure, the size of the second fixing groove 437*b* connected to the supporter 436 may be larger than that of the first fixing groove 437*a*. The second fixing groove 437*b* may be provided at a position corresponding to the insertion portion 438 described below. That is, the second fixing groove 437*b* may be disposed on a same extension line as the insertion portion 438 in the forward and rearward direction.

With this structure, a fixing position of the door frame 41 and a fixing position of the door liner 42 may be provided on the same extension line in the forward and rearward direction, thereby effectively restricting horizontal movement when the inner frame 43 is coupled to the door frame 41 and the door liner 42.

The insertion portion 438 may be disposed at a front side of the body 432 and may be recessed rearward to receive the fixer 415 of the door frame 41.

The insertion portion 438 has a shape corresponding to that of the fixer 415 such that the fixer 415 is inserted into and coupled to the insertion portion 438. By the insertion and coupling, the inner frame 43 may be mounted on the door frame 41.

In addition, the insertion portion 438 may include an inclined surface 438*a* that becomes narrower going from the front to the rear. That is, for the inclined surface 438*a*, a gap defined at a front side of the insertion portion 438 may be larger than a gap defined at a rear side of the insertion portion 438. Therefore, the operator may easily insert the fixer 415 into the insertion portion 438 when coupling the inner frame 43 to the door frame 41 by mounting the inner frame 43 on the door frame 41.

A frame supporter 439 may be disposed at both sides of the insertion portion 438 to support the door frame 41.

The frame supporter 439 may include a first frame supporter 439*a* bent inward from a front end of the body 432 and a second frame supporter 439*b* bent outward from the front end of the body 432. The frame supporter may have a thickness corresponding to that of the body 432.

The first frame supporter 439*a* may extend in a direction closer to a rear surface of the door frame 41. An end of the first frame supporter 439*a* may extend to a corner defined by the frame stepped portion 414 and the rear surface of the door frame 41 when the inner frame 43 is mounted on the door frame 41 by inserting the fixer 415 into the insertion portion 438.

In addition, the second frame supporter 439*b* may include a supporting surface 439*c* that extends outward along a rear surface of the door frame 41. The second frame supporter 439*b* contacts a portion of the rear surface of the door frame 41 and the inner frame 43 may be firmly mounted on the door frame 41. That is, the second frame supporter 439*b* may further include the supporting surface 439*c* that extends in parallel to the rear surface of the door frame 41.

With the structure of the frame supporter 439, the door frame 41 and the inner frame 43 may be firmly coupled, and the penetration of the foaming liquid into a space of the insertion portion 438 may be prevented when injecting the foaming liquid.

The gap between the door frame 41 and the door liner 42 may be minimized by the inner frame 43 when mounting the door liner 42 on the door frame 41. For example, according to the present disclosure, the gap between the door frame 41 and the door liner 42 may be at least 5 mm or less, for example, 1 mm or less.

That is, an additional post process of sealing the gap between the door frame 41 and the door liner 42 is not required in the assembly process of the main door 40 according to the embodiment of the present disclosure.

For example, the main door 40, the door frame 41 and the door liner 42 are coupled to each other by a jig, and in this case, the inner frame 43 is mounted between the door frame 41 and the door liner 42. Subsequently, after injecting the foaming liquid, the door frame 41 is coupled to the door liner 42.

In this case, in the embodiment of the present disclosure, the assembly process of the main door 40 may be completed in a state in which the gap-sealing process of minimizing the gap between the door frame 41 and the door liner 42 to prevent the leakage of the foaming liquid is omitted.

Therefore, as the post process is omitted, the assembly process of the main door 40 may be effectively simplified, thereby improving productivity thereof and reducing material cost thereof.

What is claimed is:

1. A refrigerator comprising:

a cabinet providing a storage space; and a main door to open and close the cabinet and defining an opening, and a sub door to open and close the opening of the main door, wherein the main door comprises:

a door frame comprising the opening and defining a front surface of the main door;

a door liner coupled to the door frame to provide an insulating space and defining a rear surface of the main door; and an inner frame disposed inside the insulating space along a circumference of the opening of the main door and connecting the door frame to the door liner, wherein the inner frame comprises:

an inner opening that penetrates an area corresponding to the opening of the main door in a forward and rearward direction;

a body disposed along a circumference of the inner opening and that extends between the door frame and the door liner in a forward and rearward direction; and a curved portion extending rearward from a rear end of the body and defined at a rear side of the inner frame, which connects to the door liner, wherein the main door further comprises an insulating material filled in the insulating space, and the insulating material is formed by injecting foaming liquid, which applies pressure on the curved portion, wherein the door liner comprises:

a liner opening that communicates with the opening of the main door;

a rear frame that protrudes rearward along a circumference of the liner opening; and a connector connecting the liner opening and the rear frame, wherein the curved portion is rounded and extends rearward from a rear end of the body to surround the connector, and wherein the curved portion is in surface contact with the connector.

2. The refrigerator of claim 1, wherein the inner frame further comprises a supporter that extends from the rear side of the body in a direction toward the opening of the main door.

3. The refrigerator of claim 2, wherein the door frame comprises a frame stepped portion that protrudes rearward along the circumference of the opening of the main door at a rear surface thereof, and the supporter extends to a point where the frame stepped portion and the connector meet.

4. The refrigerator of claim 1, wherein the door frame comprises a fixer that protrudes rearward for coupling to the inner frame.

5. The refrigerator of claim 4, wherein the inner frame further comprises an insertion portion recessed rearward to receive the fixer and the insertion portion comprises a pair of opposing surfaces that are spaced apart from each other by a predetermined distance.

6. The refrigerator of claim 5, wherein at least one of the pair of opposing surfaces of the insertion portion comprises an inclined surface and the distance of the inclined surface decreases going toward a rear of the inclined surface from a front of the inclined surface.

7. The refrigerator of claim 5, wherein the inner frame further comprises a frame supporter is disposed at either side of the insertion portion and extends toward the door frame.

8. The refrigerator of claim 7, wherein the frame supporter comprises:

a first frame supporter that is bent and extends inward from a front end of the body of the inner frame; and a second frame supporter that is bent and extends outward from the front end of the body of the inner frame.

9. The refrigerator of claim 8, wherein the second frame supporter further comprises a supporting surface that extends to contact a portion of a rear surface of the door frame.

10. The refrigerator of claim 5, wherein the inner frame further comprises a fixing groove defined between the supporter and the curved portion and recessed to accommodate an adhesive member.

11. The refrigerator of claim 10, wherein the fixing groove and the insertion portion are on a same extension line that is extending in a forward and rearward direction.

12. The refrigerator of claim 1, wherein the inner frame further comprises a bending portion that is bent and extends from an end of the curved portion.

13. The refrigerator of claim 12, wherein the bending portion is inclined toward the front as the bending portion protrudes away from the liner opening.

14. The refrigerator of claim 1, wherein the inner frame further comprises a plurality of first protrusions that protrude inward along a circumference of the body and are spaced apart from one another at regular distance.

15. The refrigerator of claim 14, wherein the inner frame further comprises a plurality of second protrusions that protrude outward along the circumference of the body and are spaced apart from one another at regular distance.

16. The refrigerator of claim 1, wherein a distance between the door frame and the door liner is less than 5 mm.

* * * * *